United States Patent [19]

Kötting

[11] Patent Number: 4,870,785

[45] Date of Patent: Oct. 3, 1989

[54] LENS HOLDER FOR AN APPARATUS FOR GRINDING THE EDGES OF A LENS

[75] Inventor: Fritz Kötting, Dormagen, Fed. Rep. of Germany

[73] Assignee: Wernicke & Co. GmbH, Düsseldorf, Fed. Rep. of Germany

[21] Appl. No.: 177,107

[22] Filed: Apr. 4, 1988

[30] Foreign Application Priority Data

Apr. 4, 1987 [DE] Fed. Rep. of Germany ... 8705045[U]

[51] Int. Cl.[4] ..... B24B 13/005

[52] U.S. Cl. ..... 51/217 L; 51/284 R

[58] Field of Search ..... 51/217 L, 216 LP, 284 R, 51/101 LG; 269/61, 226

[56] References Cited

U.S. PATENT DOCUMENTS

| | | | |
|---|---|---|---|
| 737,313 | 8/1903 | Bader | 51/217 L |
| 3,188,077 | 6/1965 | Olson | 269/226 |

*Primary Examiner*—Robert P. Olszewski
*Assistant Examiner*—Maurina Rachuba
*Attorney, Agent, or Firm*—Becker & Becker, Inc.

[57] ABSTRACT

A lens holder for an apparatus for grinding the edges of a lens. The lens holder includes two coaxial, rotatable shaft halves having adjacent ends between which the lens is held. One of the shaft halves is axially shiftable to permit insertion, securing, and removal of the lens. To secure the lens, the axially adjustable shaft half is connected with the piston of a piston/cylinder unit or with a portion of a worm or screw drive. To release the lens, the piston of the piston/cylinder unit, or the gear portion of the worm or screw drive, is manually axially moved along with the shaft half.

4 Claims, 1 Drawing Sheet

LENS HOLDER FOR AN APPARATUS FOR GRINDING THE EDGES OF A LENS

BACKGROUND OF THE INVENTION

The present invention relates to a lens holder for an apparatus for grinding the edges of a lens. The lens holder includes two coaxial, rotatable shaft halves that have adjacent ends between which the lens is held, with one of the shaft halves being axially shiftable to permit insertion, securing, and removal of the lens.

Lens holders of this general type are known. With such holders, securing of the lens is effected via pressure medium, with a pressure-relief valve being provided via which, during feeding or advancement of the axially adjustable shaft half, the latter is subjected to a weaker pressure until it rests against the lens. For the final securement of the lens, which is subjected to a radial grinding pressure during the grinding process, a greater pressure can be exerted upon the axially adjustable shaft half. If with this heretofore known lens holder the greater pressure is inadvertently applied before the free end of the axially adjustable shaft half rests against the lens, the danger exists that this shaft half, at high pressure, will strike either the lens, which is not yet in the proper position between the two shaft halves, or one or more fingers of the operator. It is an object of the present invention to provide a lens holder that avoids these drawbacks with structurally straightforward means.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

The lens holder of the present invention is characterized primarily in that for securing the lens, the axially adjustable shaft half is axially connected with the piston of a cylinder/piston unit or with a portion of a worm or screw drive, while to release the lens, the piston or the portion of the worm or screw drive is manually axially movable along with the axially shiftable shaft half.

The lens holder of the present invention offers the advantage that the axially adjustable shaft half can be fed or advanced via two independent means, as a result of which the danger of an inadvertent incorrect operation of the shaft half is avoided. The advancement of the axially adjustable shaft half, on the one hand, can be arbitrarily effected manually, while the securement of the lens, on the other hand, can be effected with the aid of pneumatic means or by moving the worm or screw drive. Further advantages of the inventive lens holder include its straightforward construction, and in particular its unproblematic operation. In this connection, the force for securing the lens can be made effective only after the axially adjustable shaft half has reached a position in which the lens is secured in its position thus precluding pinching of the fingers of an operator.

Further specific features of the present invention will be described in detail subsequently.

DESCRIPTION OF PREFERRED EMBODIMENTS

Figure 1:
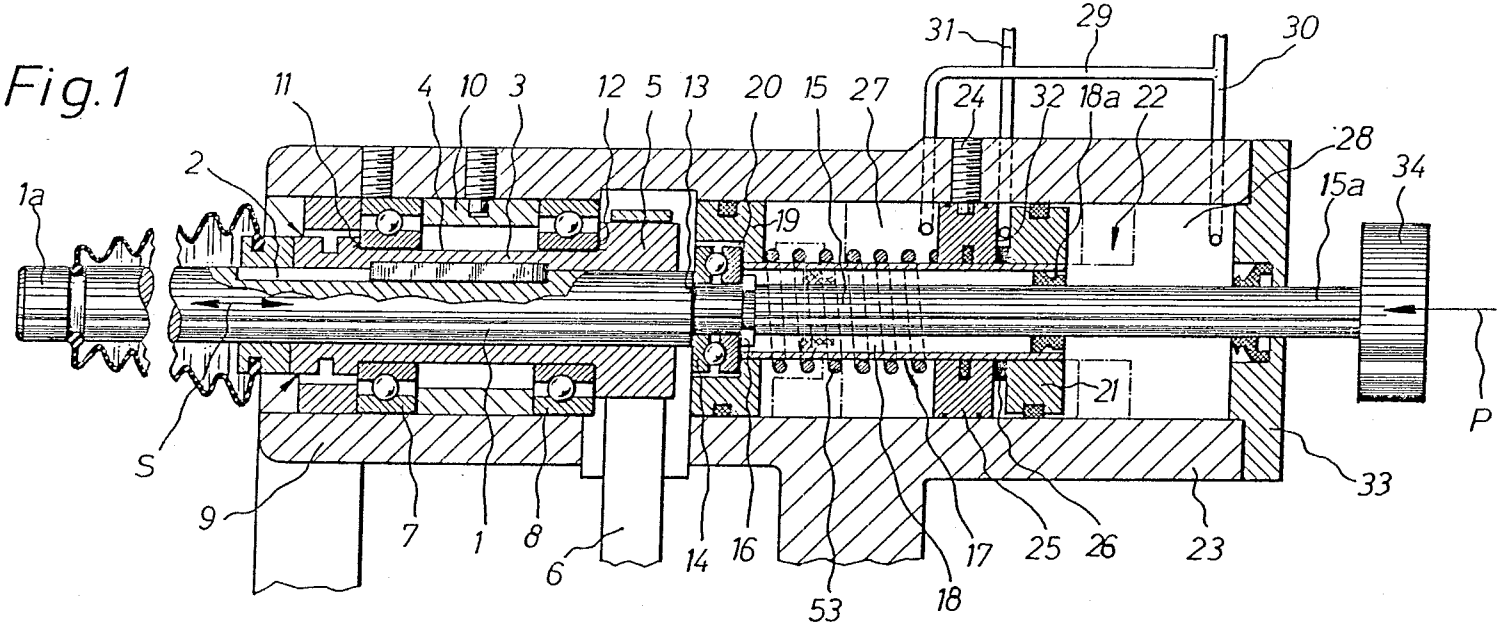
FIG 1 is a cross-sectional view of one exemplary embodiment of the inventive lens holder with the lens being secured in the holder for a grinding process via a pressure medium.

Referring now to the drawing in detail, the lens is held in the edge-grinding apparatus in a known manner between two shaft halves, with only the axially adjustable shaft half 1 being illustrated in FIG. 1. The non-illustrated shaft half, which cannot be shifted axially, supports on its free end the template or pattern, in conformity with the periphery of which the contour of the lens is produced. As a result of the rotational movement of the driven shaft half 1, through the interposition of the lens the second shaft half is also rotated. This technology is known.

In the embodiment illustrated in FIG. 1, the front end 1*a* of the shaft half 1 is provided with a non-illustrated suction device that is rigidly connected to the shaft 1 and holds the lens in position during the grinding process. The shaft half 1 is axially movable in the direction of the double arrow S in order to provide the necessary space between itself and the non-illustrated second shaft half for the insertion of the lens.

Although for the grinding process a relatively high contact pressure of the shaft and its suction device against the lens is necessary, until the suction device rests against the lens only a relatively small feed pressure should be exerted upon the shaft 1 in order to preclude damage to the lens or injury to the fingers of the operator.

The shaft 1 is provided with a groove 2 into which the key (or tongue) 3 can extend. The groove 2 is longer than the key (or tongue) 3, so that the latter can shift in the longitudinal direction in the groove 2. The key 3 is held in a sleeve 4, with that end thereof that is remote from the shaft end la being connected to a drive gear or pinion 5, or being embodied as such. Disposed about the pinion 5 is a belt or chain 6 that provides for rotation of the shaft 1 about its longitudinal axis.

With the aid of two bearings 7 and 8, the central portion of the sleeve 4 is rotatably mounted in the housing portion 9. The two bearings 7, 8 are held in a position where they are spaced from one another via a spacer 10, and rest against shoulders 11, 12 of the sleeve 4.

The shaft 1 forms a further shoulder 13, against which a thrust bearing 14 rests. The latter is disposed upon a reduced diameter portion 15 of the shaft 1, and is axially held thereupon via, for example, a ring 16. Disposed against the end of the bearing 14 or the ring 16 is a sleeve 17 that surrounds the reduced diameter portion 15 and is spaced therefrom. The space 18 formed in this manner serves to accommodate one or more sealing members, such as the sealing member indicated by the reference numeral 18*a*. Disposed on the front end of the sleeve 17, which faces the shaft end 1*a*, is a piston-like member 19, in the recess 20 of which the thrust bearing 14 is accommodated. The other end of the sleeve 17 also has securely connected thereto a second piston-like member 21.

The two piston-like members 19 and 21 are axially movable in a cylindrical space 22 that is provided in the portion 23 of the housing. The two piston-like members 19 can be axially shifted by being acted upon in a manner that will be described subsequently.

Provided approximately in the central portion of the cylindrical space 22 is a partition 25 that is securely connected to the housing portion 23 via a screw 24, and that is disposed parallel to the piston-like members 19, 21. A spacer 26 can be provided on he sleeve 17 between the partition 25 and the piston-like member 21; the spacer 26 has an outer diameter that is less than that of the partition 25 or member 21.

The cylindrical space 22 is divided into a zone 27 that is disposed ahead of the partition 25, and a zone 28 that is disposed behind the partition 25. A respective pressure-medium line 29, 30 opens into these zones of the cylindrical space. A further line 31 can open into the space 32 between the partition 25 and the piston-like member 21.

The reduced diameter portion 15 of the shaft 1 extends through the thrust bearing 14, the ring 16, the sleeve 17, the sealing member 18*a*, the zone 28 of the cylindrical space 22, and the housing cover 33 that closes off the zone 28. An operating knob 34 can be disposed on the free end 15*a* of the shaft portion 15.

If no pressure is present in the zones 27, 28 and the space 32, the shaft 1 can be manipulated with the aid of the knob 34, and can be shifted in the axial direction (the arrow P) toward the lens. If pressure medium is then introduced into the two zones 27 and 28 of the cylindrical space 22, the pressure necessary for securely holding the lens in position for the grinding process is produced.

To release the lens, the pressure is removed from the zones 27 and 28, and the shaft half 1, along with its portion 15, is manually retracted counter to the direction of the arrow P. Retraction of the shaft half 1 for releasing the lens can also be undertaken by introducing pressure medium at low pressure via the line 31 into the space 32 between the partition 25 and the piston-like member 21.

Figure 2:
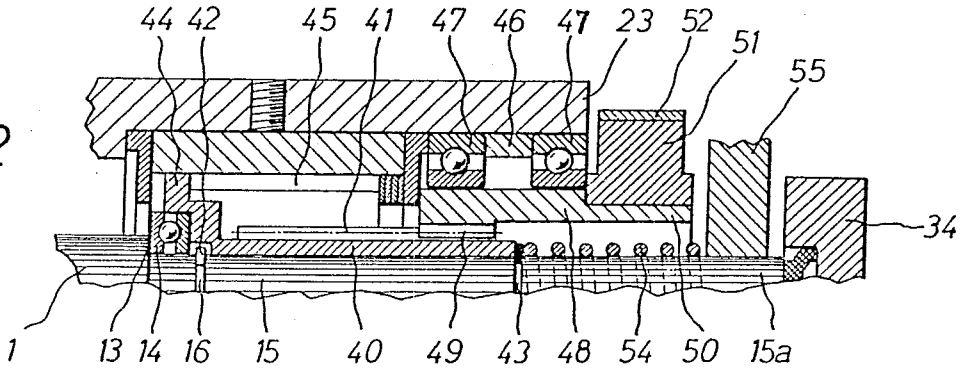
FIG. 2 is a cross-sectional view through part of a second exemplary embodiment of the inventive lens holder, where the lens is secured by a worm or screw drive.

In the embodiment illustrated in FIG. 2, a thrust bearing 14 again rests against the shoulder 13 of the shaft half 1; the thrust bearing 14 is prevented from shifting axially upon the reduced diameter portion 15 of the shaft 1 via the ring 16. Disposed on the shaft portion 15 is a sleeve 40 that has a trapezoidal thread 41. With the aid of the ring 16, the sleeve 40 is prevented from shifting toward the one side on the shaft portion 15, with the ring 16 extending into an annular recess 42 of the sleeve 40. Via a second ring 43 on the shaft portion 15, the sleeve 40 is prevented from shifting in the second longitudinal direction on this shaft portion.

The sleeve 40 is provided with a projecting arm 44 that is able to slide, as a sliding block, in a groove 45 of the housing portion 23. Provided in this housing portion are two bearings 47 that are maintained at a distance from one another via a spacer 46. The bearings 47 are provided for a worm gear 48, the outer surface of which rests against these bearings. The inner surface of the worm gear 48 is provided with a worm thread 49 that meshes with the trapezoidal thread 41 of the sleeve 40. Disposed on the portion 50 of the worm gear 48 is a drive gear or pinion 51; alternatively, such a pinion can be integrally formed with the worm gear 48. Disposed about the pinion 51 is a drive belt 52 for the worm gear 48. By rotating the pinion 51, the sleeve 40 is axially shifted in the longitudinal direction, taking along with it in the axial direction the shaft 1 and the portion 15 of the latter. If the knob 34 is moved in the axial direction, the shaft portion 15 takes along with it the sleeve 40, which with the aid of its projecting arm 44 and the sliding movement of the latter in the groove 45 cannot rotate, thus causing the worm gear 48 to rotate.

In the embodiment of FIG. 1, a spring 53 is disposed between the piston-like member 19 and the partition 5; these two components form abutments for the spring. Since the spring 53 exerts only a slight pressure upon the member 19, and hence upon the shaft, in the feed direction of the latter (toward the left in FIG. 1), the knob 34 can easily be moved to the right. After the knob 34 is released, the shaft slides smoothly and to a large extent without pressure to the left (in FIG. 1), exerting enough pressure that the lens is held between the shaft halves.

In the embodiment of FIG. 2, a similar spring 54 is disposed between a fixed housing portion 55 and the reduced diameter shaft portion 15 or the ring 43.

The present invention is, of course, in no way restricted to the specific disclosure of the specification and drawing, but also encompasses any modifications within the scope of the appended claims.

What I claim is:

1. A lens holder for an apparatus for grinding the edges of a lens, said lens holder including two coaxial, rotatable shaft halves having adjacent ends between which said lens is held, with one of said shaft halves being axially shiftable via application of pressure to permit insertion, securing, and removal of said lens and keeping the lens in its grinding position; said lens holder in combination further comprising:

a housing through which said axially shiftable shaft half extends; and two separate adjustment systems including resilient means to urge said axially shiftable shaft half lightly with a nominal pressure in a predetermined direction toward the lens kept thereby in its grinding position as well as rigid mechanical means disposed in said housing independently of said resilient means and operatively connected directly to said axially shiftable shaft half to exert a pressure directly on the lens greater than the nominal pressure to keep the lens in its grinding position for securing said lens during grinding thereof, with said rigid mechanical means being movable with said axially shiftable shaft half.

2. A lens holder in combination according to claim 1, in which said rigid mechanical means to exert pressure on said axially shiftable shaft half to effect displacement thereof includes a worm or screw drive that has a portion that is adapted to be acted upon mechanically and to thereupon act upon said axially shiftable shaft half for axially displacing the latter.

3. A lens holder in combination according to claim 2, in which said rigid mechanical means to exert pressure on said axially shiftable shaft half to effect displacement thereof further includes a worm gear that is rotatably yet non-axially-shiftably disposed in said housing; and in which said portion of said worm or screw drive is a trapezoidally threaded sleeve that is carried directly by said axially shiftable shaft half and that is axially movable with the latter relative to said rotatable worm gear.

4. A lens holder in combination according to claim 1, which resilient means includes a spring that exerts pressure and acts upon said axially shiftable shaft half to effect displacement thereof to lightly urge same in a direction toward a lens end thereof.

* * * * *